US006234276B1

(12) United States Patent
Wagatsuma et al.

(10) Patent No.: US 6,234,276 B1
(45) Date of Patent: May 22, 2001

(54) TRACTION TYPE ELEVATOR HAVING CABLE HITCHES SECURING CABLE ENDS TO GUIDE RAILS

(75) Inventors: Yasuyuki Wagatsuma, Saitama-ken; Kazuaki Miyakoshi, Kanagawa-ken, both of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/396,348

(22) Filed: Sep. 14, 1999

(30) Foreign Application Priority Data

Sep. 14, 1998 (JP) ..... 10-260498

(51) Int. Cl.[7] ..... B66B 7/08
(52) U.S. Cl. ..... 187/411; 187/406; 187/412
(58) Field of Search ..... 187/411, 264, 187/266, 406, 412, 404

(56) References Cited

U.S. PATENT DOCUMENTS

| | | | | |
|---|---|---|---|---|
| 1,282,374 | * | 10/1918 | Buckley | 187/411 |
| 1,418,089 | * | 5/1922 | Lindquist | 187/412 |
| 1,881,459 | * | 10/1932 | Frost | 187/412 |
| 2,322,774 | * | 6/1943 | Polack | 187/411 |
| 4,537,286 | * | 8/1985 | Morris et al. | 187/412 |
| 5,080,201 | * | 1/1992 | Yoo et al. | 187/404 |
| 5,353,893 | * | 10/1994 | Sun et al. | 187/412 |
| 5,490,577 | * | 2/1996 | Yoo | 187/266 |
| 5,611,412 | * | 3/1997 | Yoo et al. | 187/412 |
| 5,878,847 | * | 3/1999 | Mustalahti et al. | 187/406 |
| 5,899,300 | * | 5/1999 | Miller et al. | 187/266 |
| 6,021,873 | * | 2/2000 | Aulanko et al. | 187/411 |
| 6,065,569 | * | 5/2000 | Fuller | 187/411 |
| 6,085,874 | * | 7/2000 | Uchino et al. | 187/411 |

FOREIGN PATENT DOCUMENTS

| | | | | |
|---|---|---|---|---|
| 403051284 | * | 3/1991 | (JP) | 187/264 |
| 404016478 | * | 1/1992 | (JP) | 187/411 |
| 405032385 | * | 2/1993 | (JP) | 187/412 |
| 10-231077 | | 9/1998 | (JP) . | |

* cited by examiner

*Primary Examiner*—Eileen D. Lillis
*Assistant Examiner*—Paul T. Chin
(74) *Attorney, Agent, or Firm*—Oblon, Spivak, McClelland, Maier & Neustadt, P.C.

(57) ABSTRACT

An elevator including a cage configured to ascend and descend in an elevator shaft along a cage guide rail, a counterweight configured to ascend and descend in the elevator shaft along a counterweight guide rail, a cable configured to hang and connect the cage and the counterweight, a drive unit configured to drive the cage and the counterweight by providing motive power for the cable, and a cable hitch mounted on the cage guide rail or the counterweight guide rail and configured to secure one end of the cable.

1 Claim, 12 Drawing Sheets

TRACTION TYPE ELEVATOR HAVING CABLE HITCHES SECURING CABLE ENDS TO GUIDE RAILS

CROSS REFERENCE TO RELATED APPLICATION

This application claims benefit of priority to Japanese Patent Application No. JP10-260498 filed Sep. 14, 1998.

BACKGROUND OF THE INVENTION

1. Field of the Invention

The present invention relates to an elevator with a cable hitch for securing end parts of the cable which drives a passenger cage.

2. Description of the Background

FIG. 1 shows one example of a conventional two-to-one roping type traction elevator which is constructed such that a cage speed is set to half the cable speed. In FIG. 1, a cage sheave 104 is provided at an upper portion of a cage 101 which is hanged by a cable 103 placed around the cage sheave 104. The cable 103 further around a driving sheave 107 driven by a motor (not shown) and a deflector sheave 108, and then placed around a counterweight sheave 105 mounted on an upper side of a counterweight 102.

The opposite ends of the cable 103 are secured on a machine beam (not shown) in a machine room (penthouse) 109 by means of two cable hitches 106.

However, in one type of two-to-one roping elevator which has a drive unit including the driving sheave 107, the motor and the like is disposed within an elevator shaft 110 of a building instead of the machine room 109. Thus, this kind of elevator dispenses with the machine room 109. As a result, the cable hitches 106 can not be mounted on the machine beam in the machine room 109 in the same way as the elevator shown in FIG. 1.

SUMMARY OF THE INVENTION

Accordingly, one object of the present invention is to provide a novel traction type elevator having a cable hitch optimally located in an elevator shaft.

This and other objects are achieved according to the present invention by providing a new improved elevator including a cage configured to ascend and descend in an elevator shaft along a cage guide rail, a counterweight configured to ascend and descend in the elevator shaft along a counterweight guide rail, a cable configured to hang and connect the cage and the counterweight, a drive unit configured to drive the cage and the counterweight by providing motive power for the cable, and a cable hitch mounted on one of the cage guide rail and the counterweight guide rail and configured to secure one end of the cable to said one of the cage guide rail and the counterweight guide rail.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
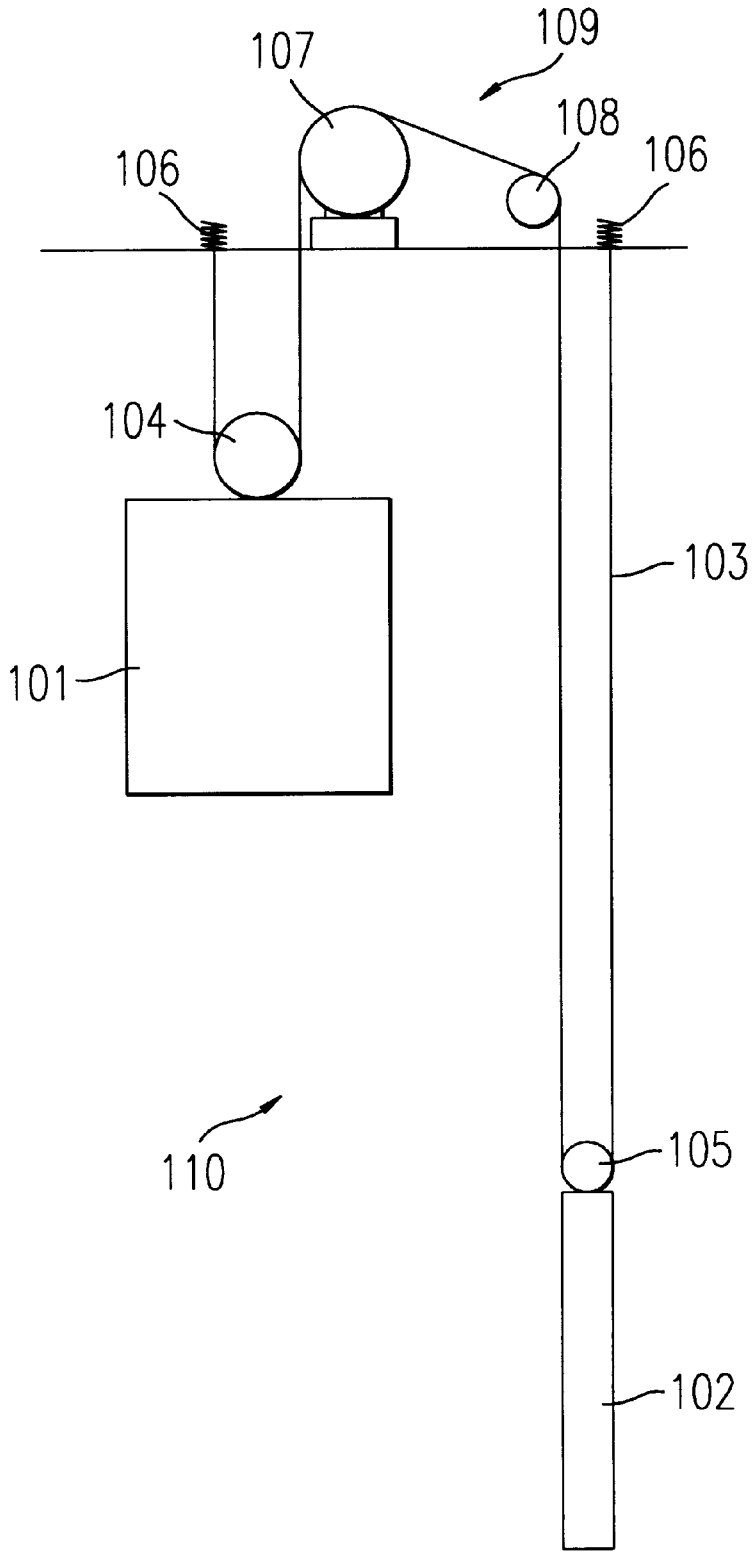
FIG. 1 PRIOR ART
FIG. 1 is a schematic view showing a conventional two-to-one roping type traction elevator.

Referring now to the drawings, where like reference numerals designate the same or corresponding parts throughout the several views, and more particularly FIGS. 2–4, there will be described a first embodiment of the invention with regard to a Two-to-One roping elevator.

Figure 2:
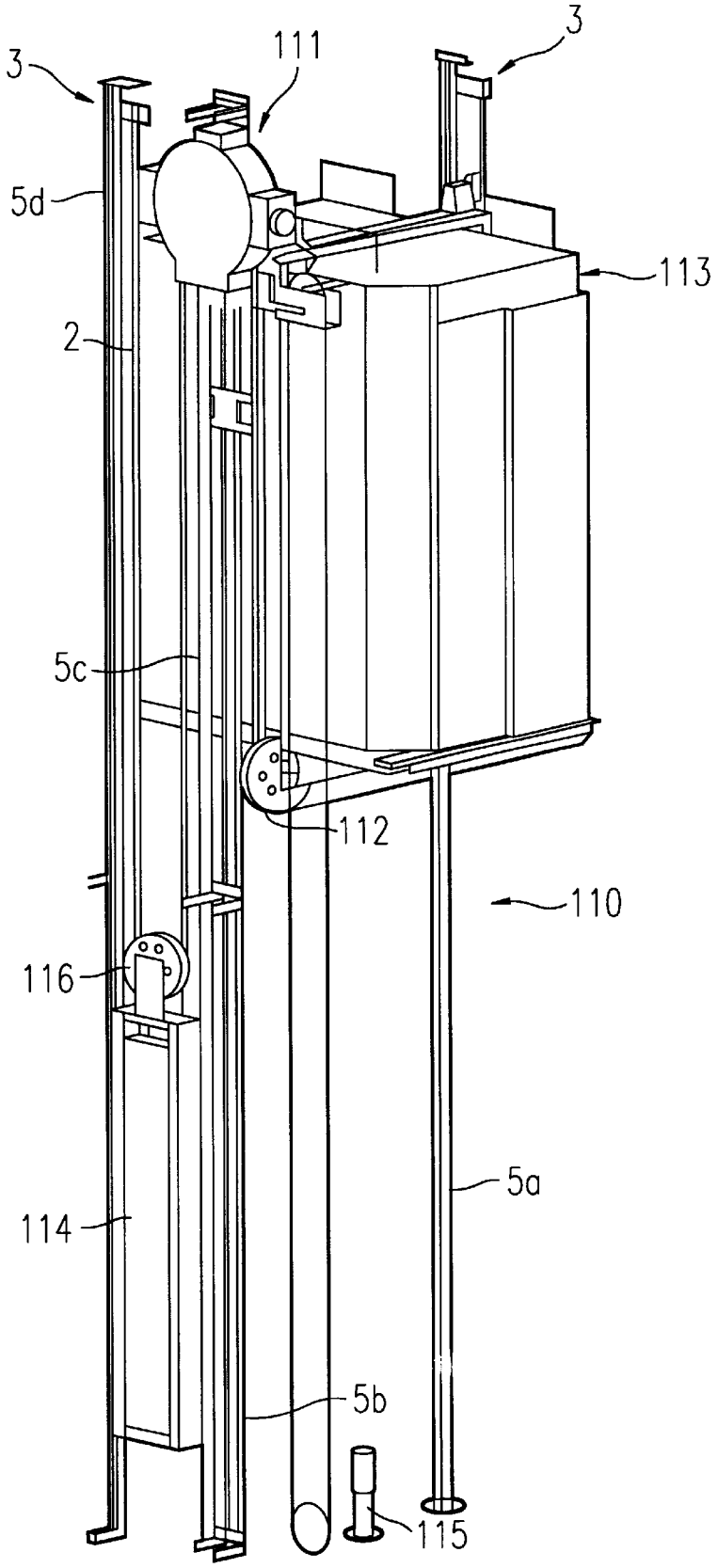
FIG. 2 is a schematic perspective view showing the two-to-one roping elevator of a first embodiment of the present invention.

FIG. 2 is a schematic perspective view showing the two-to-one roping elevator of the first embodiment of the present invention. As shown in FIG. 2, the elevator includes a pair of cage guide rails 5*a* and 5*b* to be provided in an elevator shaft 110 in a building, a cage 113 ascending and descending along the cage guide rails 5*a* and 5*b*, a pair of car sheaves 112 to be provided at the bottom of the cage 113, a counterweight 114 ascending and descending along a pair of counterweight guide rails 5*c* and 5*d*, and a counterweight sheave 116 to be provided at the upper side of the counterweight 114.

Three cables 2 (only one is shown) are placed around the counterweight sheave 116 and the car sheaves 112, and driven by a drive unit 111, thus moving the cage 113 and the counterweight 114 up and down. The drive unit 111 is disposed in the elevator shaft 110 and a damper 115 is installed at the bottom of the shaft 110.

Further, the elevator of this embodiment includes a pair of cable hitches 3 for securing the opposite ends of the cables 2 in the shaft 110. One cable hitch 3 is mounted on the cage guide rail 5*a* and another cable hitch 3 is mounted on the counterweight guide rail 5*d*.

Figure 3:
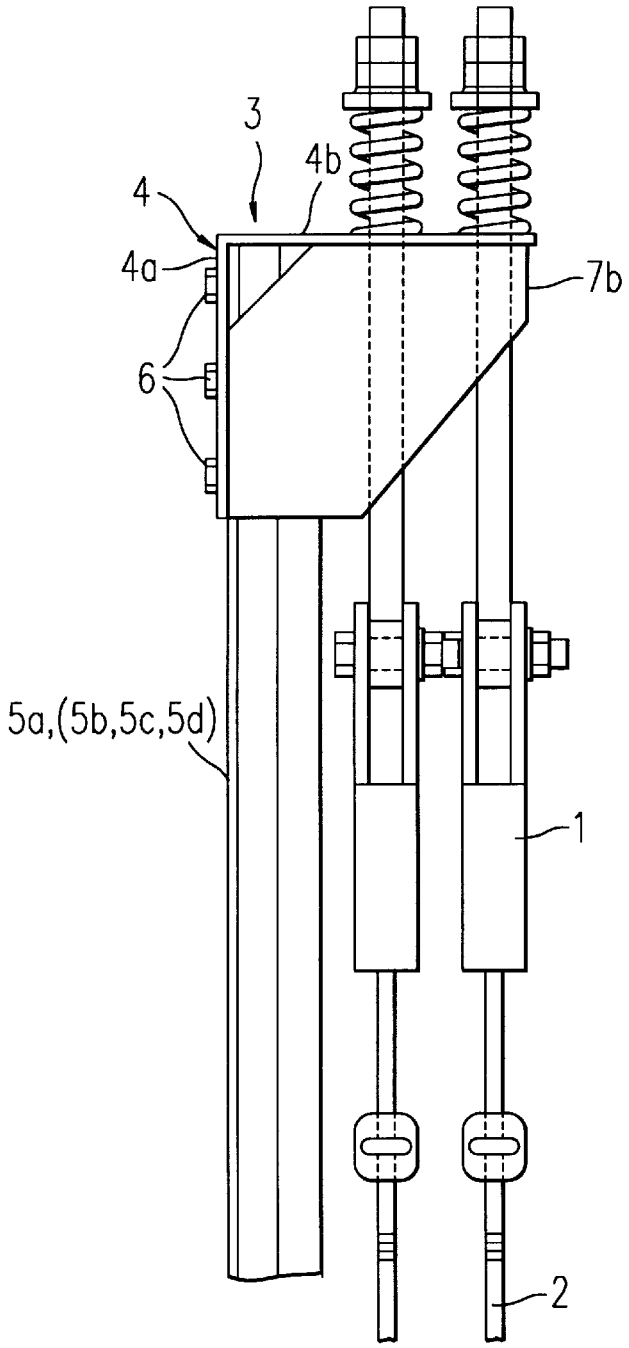
FIG. 3 is a side view showing a cable hitch of the first embodiment of the present invention.

FIG. 3 is a side view of the cable hitch 3 of the first embodiment. FIG. 4 is a front view of the cable hitch 3 shown in FIG. 3

Figure 4:
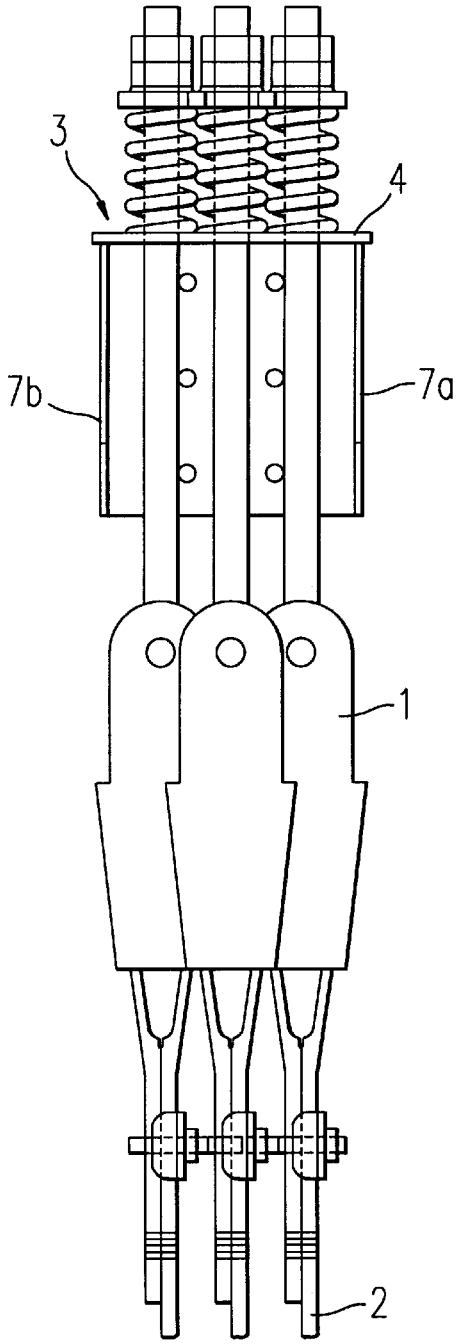
FIG. 4 is a front view of the cable hitch shown in FIG. 3.

As shown in FIGS. 3 and 4, three shackle rods 1, which are attached to the ends of the cables 2, are secured on the top of the cage guide rail 5*a* by means of the cable hitch 3. Another cable hitch 3 is mounted on the top of the counterweight guide rail 5*d* in the same way as the cable hitch 3 shown in FIGS. 3 and 4 and supports other ends of the cables 2.

In this embodiment, only the cable hitch 3 mounted on the cage guide rail 5*a* is described for the sake of convenience.

The cable hitch 3 includes an L-shaped member 4 which is mounted on the top of the cage guide rail 5*a*. A longitudinal section of member 4 has the shape of an inverted L. The L-shaped member 4 is composed of a vertically extending portion and a horizontally extending portion.

The vertically extending portion forms a base 4*a* to be secured on a back side of the cage guide rail 5*a,* while the horizontally extending portion forms a support 4*b* for supporting the ends of the cables 2. The support 4*b* extends toward the opposite cage guide rail 5*b,* thus the position where the cables 2 is supported on the cable hitch 3 is offset from the side of the cage guide rail 5*b*.

The base 4*a* of the L-shaped member 4 is secured to a back side of the cage guide rail 5*a* by six bolts 6 (only three are shown). The base 4*a* can be welded to the back side of the cage guide rail 5*a* instead of fastened thereto with the bolts 6.

A pair of reinforcing plates 7*a* and 7*b* are provided on sides of the L-shaped member 4, thereby strengthening the support for the shackle rods 1.

According to the first embodiment of the present invention, since the cable hitch 3 is mounted on the top of the cage guide rail 5*a* and supports the ends of the cables 2, it is not required that the cable hitch 3 be installed in the machine room as shown in FIG. 1.

Thus, in the case where a two-to-one roping elevator dispenses with a machine room, the size of the shaft 110 is the same as an elevator with machine room, it is not necessary to provide space protruding from the roof of the building for a machine room, and further there is no difficulty to support the ends of the cables 2.

In this embodiment and other embodiments later described, as shown in FIG. 2, although the car sheaves 112 are attached to the bottom of the cage 113, the present invention is not limited to this kind of elevator. That is, the present invention can be adapted to an elevator having car sheaves at the upper portion thereof as shown in FIG. 1 or all kinds of a two-to-one roping elevator.

Figure 5:
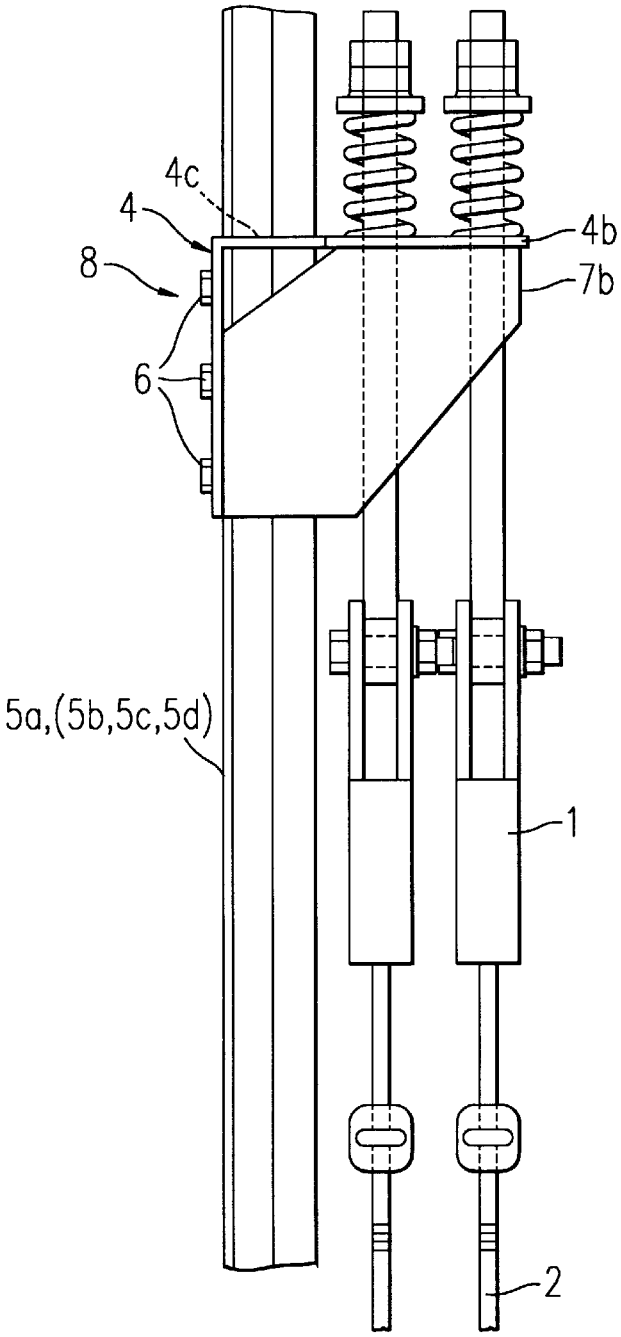
FIG. 5 is a side view of a cable hitch of a second embodiment of the present invention.
Figure 6:
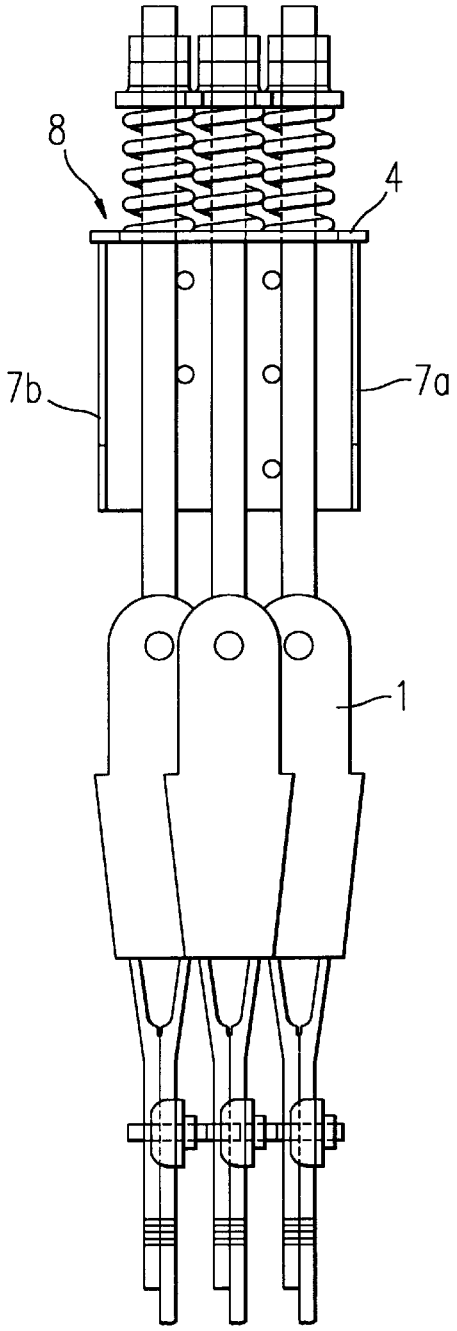
FIG. 6 is a front view of the cable hitch shown in FIG. 5.

FIG. 5 is a side view of a cable hitch of a second embodiment of the present invention. FIG. 6 is a front view of the cable hitch shown in FIG. 5. The second embodiment modifies a part of the composition of the first embodiment. Hereinafter, only components different from the components explained in the first embodiment shown in FIGS. 2–4 are described.

In the second embodiment, the support 4*b* has a cut 4*c* capable of passing through the cage guide rail 5*a*. The cage guide rail 5*a* passes through the cut 4*c,* such that the L-shaped member 4 is mounted distant from the top of the cage guide rail 5*a,* at a position where the L-shaped member 4 does not interfere with the usual motion of the cage 113 or the counterweight 114.

In this embodiment, the L-shaped member 4 is mounted on the cage guide rail 5*a* such that the longitudinal section has an inverted L shape, but the L-shaped member 4 can be mounted on the cage guide rail 5*a* such that the longitudinally section forms has a non-inverted L shape.

According to the second embodiment, since the cut 4*c* is formed on the support 4*b* and allows the cage guide rail 5*a* to pass through, the L-shaped member 4 can be mounted not only on the top of the cage guide rail 5*a* but also below the top of the cage guide rail 5*a,* as long as the L-shaped member 4 does not interfere with the cage 113 or the counterweight 114.

Figure 7:
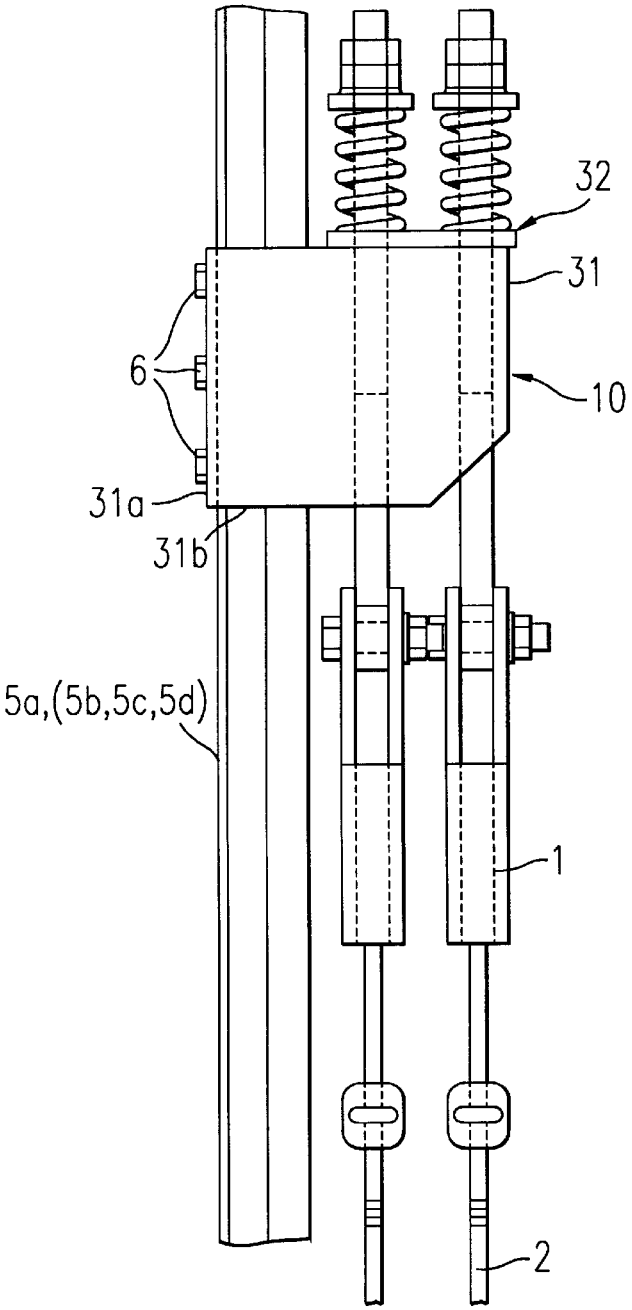
FIG. 7 is a side view of a cable hitch of the third embodiment of the invention.
Figure 8:
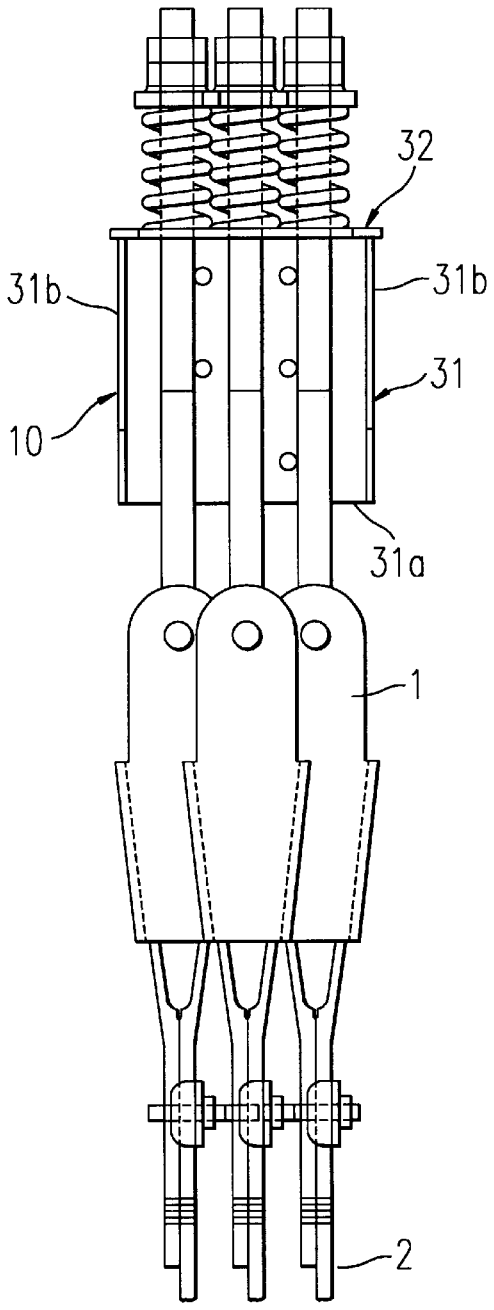
FIG. 8 is a front view of the cable hitch shown in FIG. 7.

FIG. 7 is a side view of a cable hitch of the third embodiment of the invention. FIG. 8 is a front view of the cable hitch shown in FIG. 7. The third embodiment modifies the cable hitch 3 of the first embodiment. Hereinafter, only components different from the components explained in the first embodiment shown in FIGS. 2–4 are described.

As shown in FIGS. 7 and 8, three shackle rods 1, which are attached to the ends of the cables 2, are secured below the top of the cage guide rail 5*a* by means of the cable hitch 10. The cable hitch 10 can also be mounted on the top of the cage guide rail 5*a* so as to support the ends of the cables 2 at the top of the cage guide rail 5*a*.

The cable hitch 10 includes a U-shaped member 31 which is mounted on the middle of the guide rail 5*a* such that the horizontally section thereof has a U-shape. The U-shaped member 31 is composed of a base 31*a* to be secured on a back side of the cage guide rail 5*a* and a pair of support arms 31*b* horizontally extending from both side edges of the base 31*a*.

The base 31*a* of the U-shaped member 31 is secured to a back side of the cage guide rail 5*a* by six bolts 6(only three are shown). The base 31*a* can be welded to the back side of the cage guide rail 5*a* instead of being fastened with the bolts 6.

A support plate 32 is bridged and mounted on the upper side of the support arms 31*b,* and supports the shackle rods 1. A permissible space to pass through the cage guide rail 5*a* is made between the base 31*a* and the support plate 32.

Figure 19:
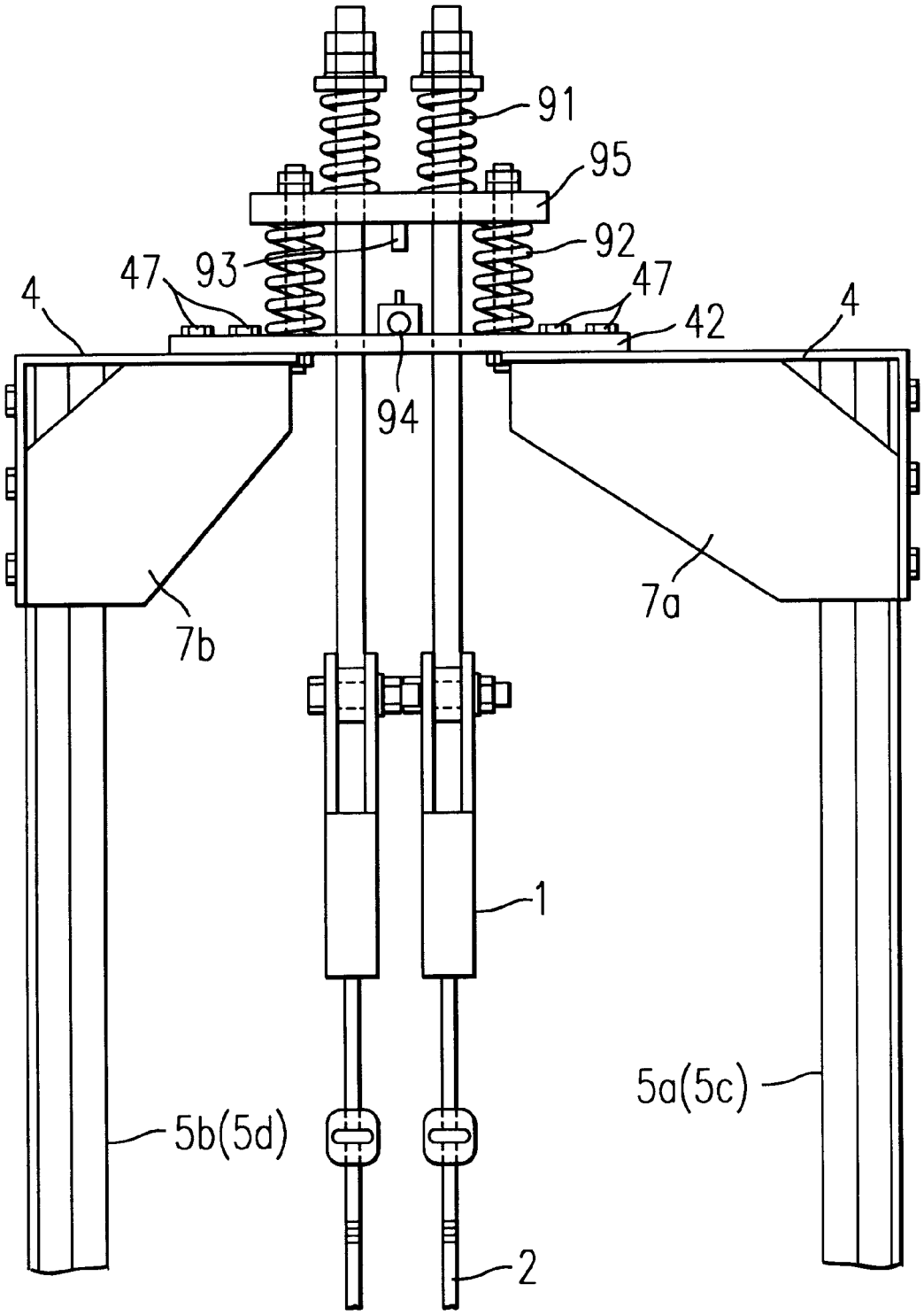
FIG. 19 is a front view of a cable hitch of the ninth embodiment of the present invention.

According to the third embodiment, since the cable hitch 10 is mounted on the cage guide rail 5*a* and supports the ends of the cables 2, it is not required that the cable hitch be installed in the machine room as shown in FIG. 19.

Figure 9:
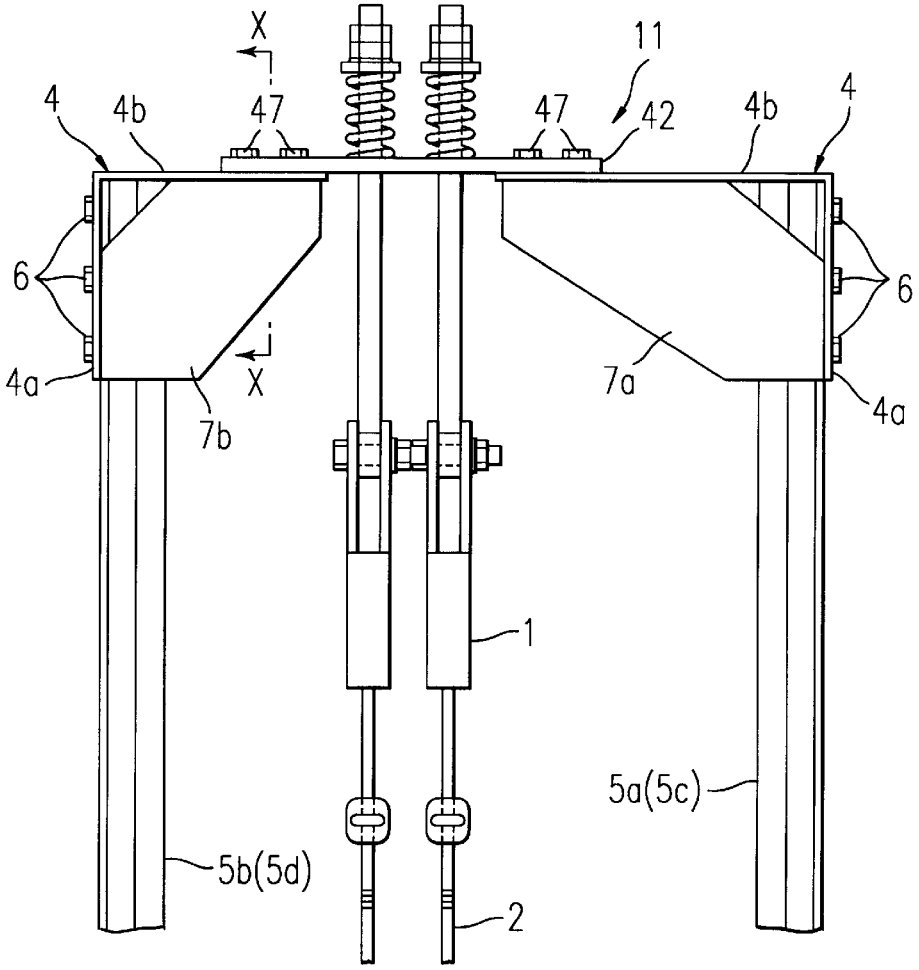
FIG. 9 is a side view of a cable hitch of a fourth embodiment of the present invention.

FIG. 9 is a side view of a cable hitch of a fourth embodiment of the present invention.

Figure 10:
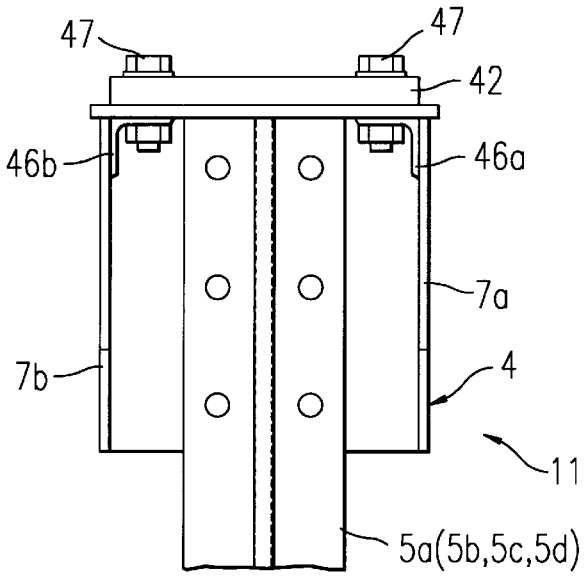
FIG. 10 is a front view of the cable hitch taken along the line X—X shown in FIG. 9.

FIG. 10 is a front view of the cable hitch shown in FIG. 9. The fourth embodiment adds some components to the first embodiment. Thus, only components different from the components explained in the first embodiment in FIGS. 2–4 are described.

As shown in FIGS. 9 and 10, one cable hitch 11 is composed of a pair of L-shaped members 4 mounted on the tops of respective of the cage guide rails 5*a* and 5*b* and supports one end of the cable 2. Another cable hitch 11 is also composed of a pair of L-shaped members 4 mounted on the tops of respective of the counterweight guide rails 5*c* and 5*d* and support the other end of the cable 2. Three shackle rods 1, which are attached to the ends of the cables 2, are secured on the top of the cage guide rail 5*a* and 5*b* by means of the cable hitch 11.

In this embodiment, only the cable hitch 11 mounted on the guide rails 5*a* and 5*b* is described for the sake of convenience.

A pair of L-shaped members 4 are respectively mounted to the cage guide rails 5*a* and 5*b* such that the longitudinal sections thereof have an inverted L-shape. The L-shaped members 4 are secured to the cage guide rails by bolts 6, but can also be welded to the cage guide rails 5*a* and 5*b* instead of being fastened with the bolts 6.

A support plate 42 is secured at the opposite ends thereof on respective supports 4*b* of the L-shaped members 4. The support plate 42 is secured to the supports 4*b* by means of bolts 47 and angle brackets 46*a* and 46*b*. The support plate 42 can also be welded to the supports 4*b* instead of bolts 47 and angle brackets 46*a* and 46*b*.

The shackle rods 1 supporting the ends of the cables 2 are secured to the support plate 42, and the installation position of the cables 2 offset from the cage guide rails 5*a* and 5*b*. A plate, which has relatively strong bending strength such as a plate having an L-shaped section or a C-shaped section, can be adapted instead of the support plate 42.

According to the fourth embodiment, since the pair of L-shaped members 4 are respectively mounted on the cage guide rails 5*a* and 5*b*, and the support plate 42 is secured at the opposite ends thereof on respective supports 4*b* of the L-shaped members 4 and supports the cables 2, the support plate 42 can efficiently support the bending moment caused by the installation position of the cables 2 being offset from the cage guide rails 5*a* and 5*b*. Thus, the permissible load of the support plate 42 is more than a cantilever structure such as the cable hitch 3 shown in FIG. 3, and a distance between the cage guide rail 5*a* or 5*b* and the installation position of the cables 2 can be made longer. As a result, the installation position of the cables 2 can be set more freely.

The U-shaped member 31 shown in FIG. 7 can be substituted for the L-shaped member 4.

Figure 11:
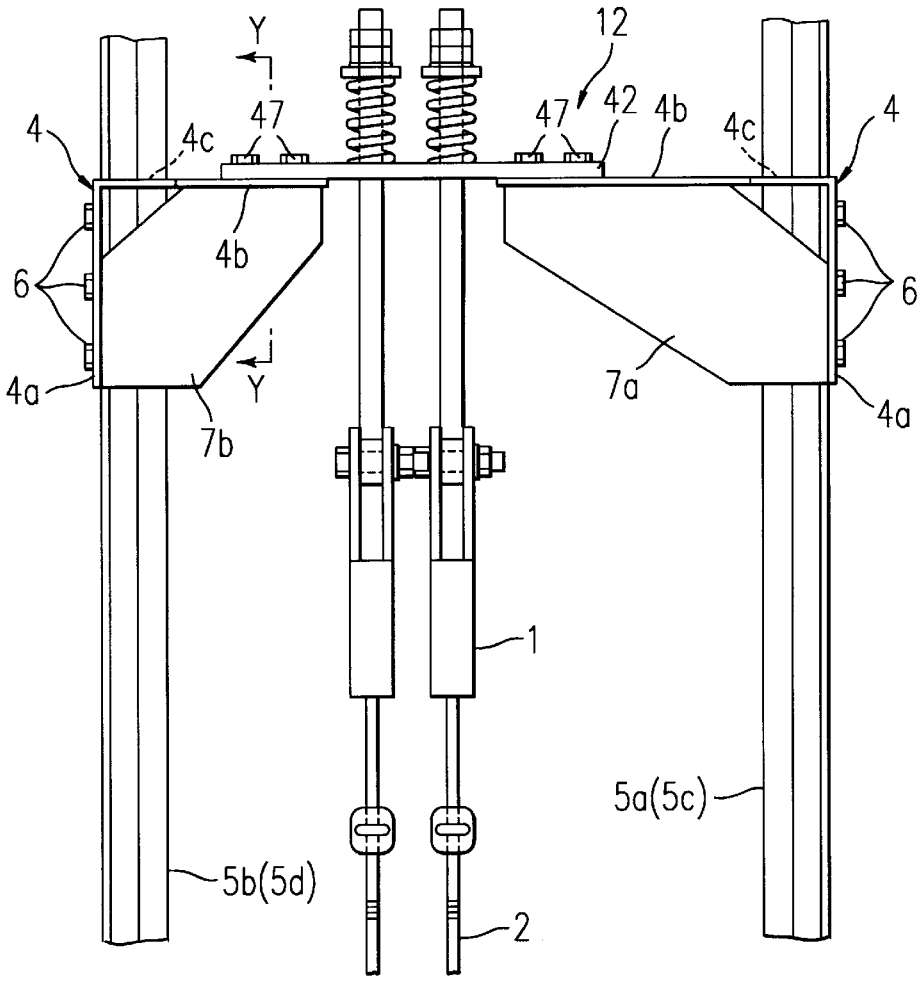
FIG. 11 is a side view of a cable hitch of a fifth embodiment of the present invention.

FIG. 11 is a side view of a cable hitch of a fifth embodiment of the present invention.

Figure 12:
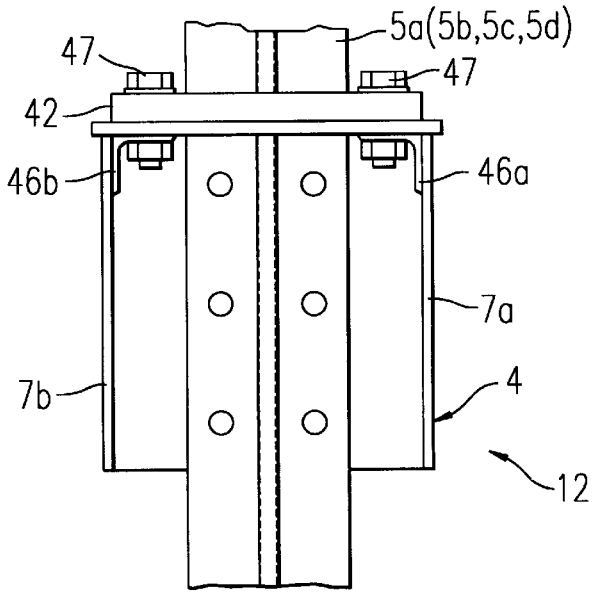
FIG. 12 is a front view of the cable hitch taken along the line Y—Y shown in FIG. 11.

FIG. 12 is a front view of the cable hitch shown in FIG. 1 1. The fifth embodiment adds some components to the second embodiment. Thus, only components different from the components explained in the second embodiment in FIG. 5 and 6 are described.

As shown in FIGS. 11 and 12, one cable hitch 12 is composed of a pair of L-shaped members 4 which are mounted distant from the tops of respective of the cage guide rails 5*a* and 5*b*. The respective L-shaped members 4 are located at same level and have cuts 4*c* for passing through the cage guide rails 5*a* and 5*b*. Another cable hitch 12 is also composed of a pair of L-shaped members 4 which are mounted distant from the tops of respective of the counterweight guide rails 5*c* and 5*d*. The respective L-shaped members 4 are located at same level and have cuts 4*c* for passing through the counterweight guide rails 5*c* and 5*d*. Three shackle rods 1 (only two are shown), which are attached to the ends of the cables 2, are secured on the middle of the cage guide rail 5*a* and 5*b* by means of the cable hitch 12. The cable hitch 12 mounted on the middle of the counterweight guide rails 5*c* and 5*d* is supported in the same way and supports the other ends of the cables 2.

In this embodiment, only the cable hitch 12 mounted on the guide rails 5*a* and 5*b* is described for the sake of convenience.

A pair of L-shaped members 4 are mounted on respective of the cage guide rails 5*a* and 5*b* such that the longitudinal sections thereof have an inverted L-shape, and are secured to the cage guide rails 5*a* and 5*b* by bolts 6. The L-shaped members 4 can otherwise be welded to the cage guide rails 5*a* and 5*b* instead of being fastened with the bolts 6. Further, the L-shaped members 4 can be mounted on the cage guide rails 5*a* and 5*b* such that the longitudinal sections thereof have a non-inverted L-shape.

A support plate 42 is secured at the opposite ends thereof on respective supports 4*b* of the L-shaped members 4 by means of bolts 47 and angle brackets 46*a* and 46*b*. The support plate 42 can be welded to the supports 4*b* instead of using bolts 47 and angle brackets 46*a* and 46*b*.

The shackle rods 1 supporting the ends of the cables 2 are secured to the support plate 42, and the installation position of the cables 2 offset from the cage guide rails 5*a* and 5*b*. A plate, which has relatively strong bending strength such as a plate having a L-shaped section or a C-shaped section, can be used instead of the support plate 42.

According to the fifth embodiment, since the pair of L-shaped members 4 are respectively mounted to the cage guide rails 5*a* and 5*b*, and the support plate 42 is secured at the opposite ends thereof on respective supports 4*b* of the L-shaped members 4 and supports the cables 2, the support plate 42 can efficiently support the bending moment caused by the installation position of the cables 2 being offset from the cage guide rails 5*a* and 5*b*. Thus, the permissible load of the support plate 42 is more than a cantilever structure such as the cable hitch 3 shown in FIG. 3, and a distance between the cage guide rail 5*a* or 5*b* and the installation position of the cables 2 can be made longer. As a result, the installation position of the cables 2 can be set more freely.

Further, since the L-shaped members 4 are mounted below the tops of the cage guide rails 5*a* and 5*b*, the vertical installation position of the cables 2 can be set freely as long as the L-shaped members 4 do not interfere with the cage 113 and the counterweight 114.

Figure 13:
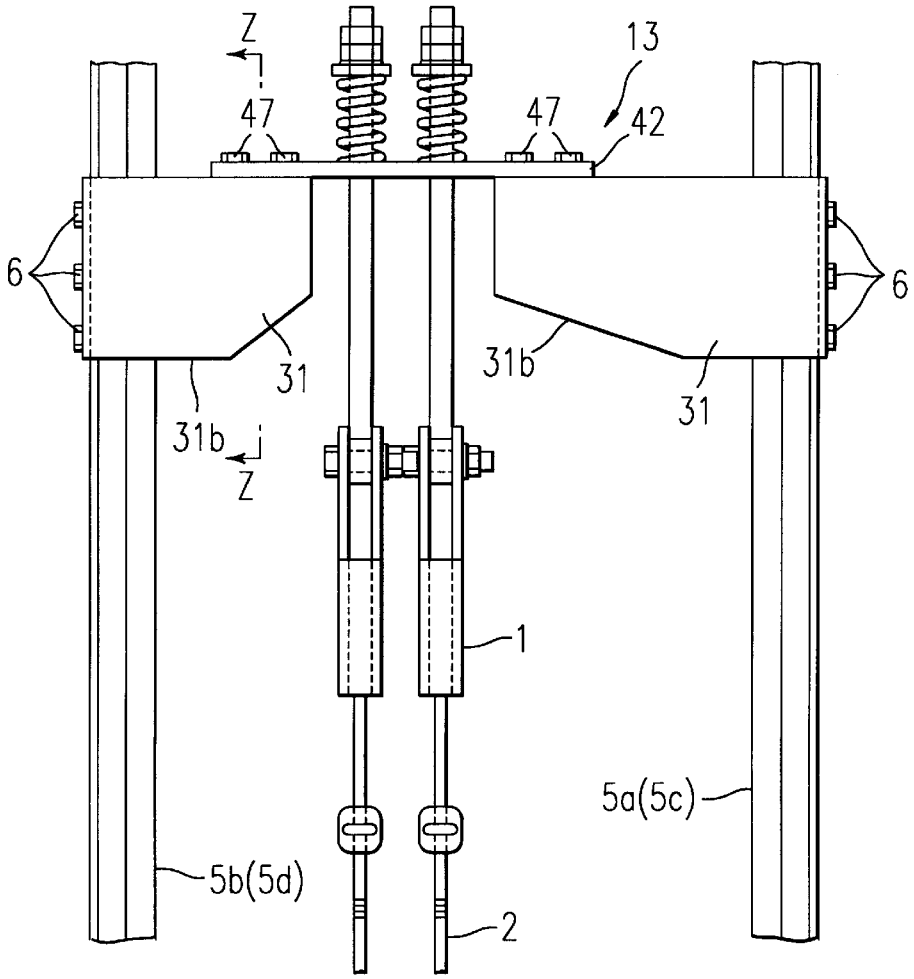
FIG. 13 is a side view of a cable hitch of a sixth embodiment of the present invention.
Figure 14:
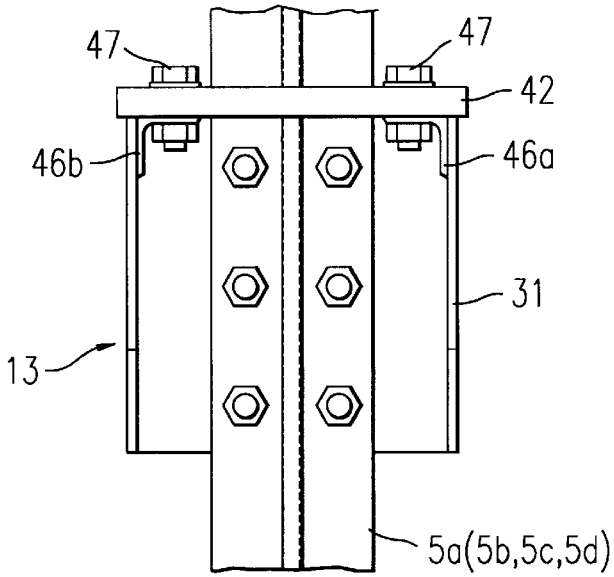
FIG. 14 is a front view of the cable hitch taken along the line Z—Z shown in FIG. 13.

FIG. 13 is a side view of a cable hitch 13 of a sixth embodiment of the present invention. FIG. 14 is a front view of the cable hitch 13 shown in FIG. 13.

As shown in FIGS. 13 and 14, the U-shaped member 31 shown in FIG. 7 is substituted for the L-shaped member 4 in the fifth embodiment in FIG. 11. The other components are the same as the fifth embodiment. Accordingly, the sixth embodiment can also obtain the same effect as the fifth embodiment.

Figure 15:
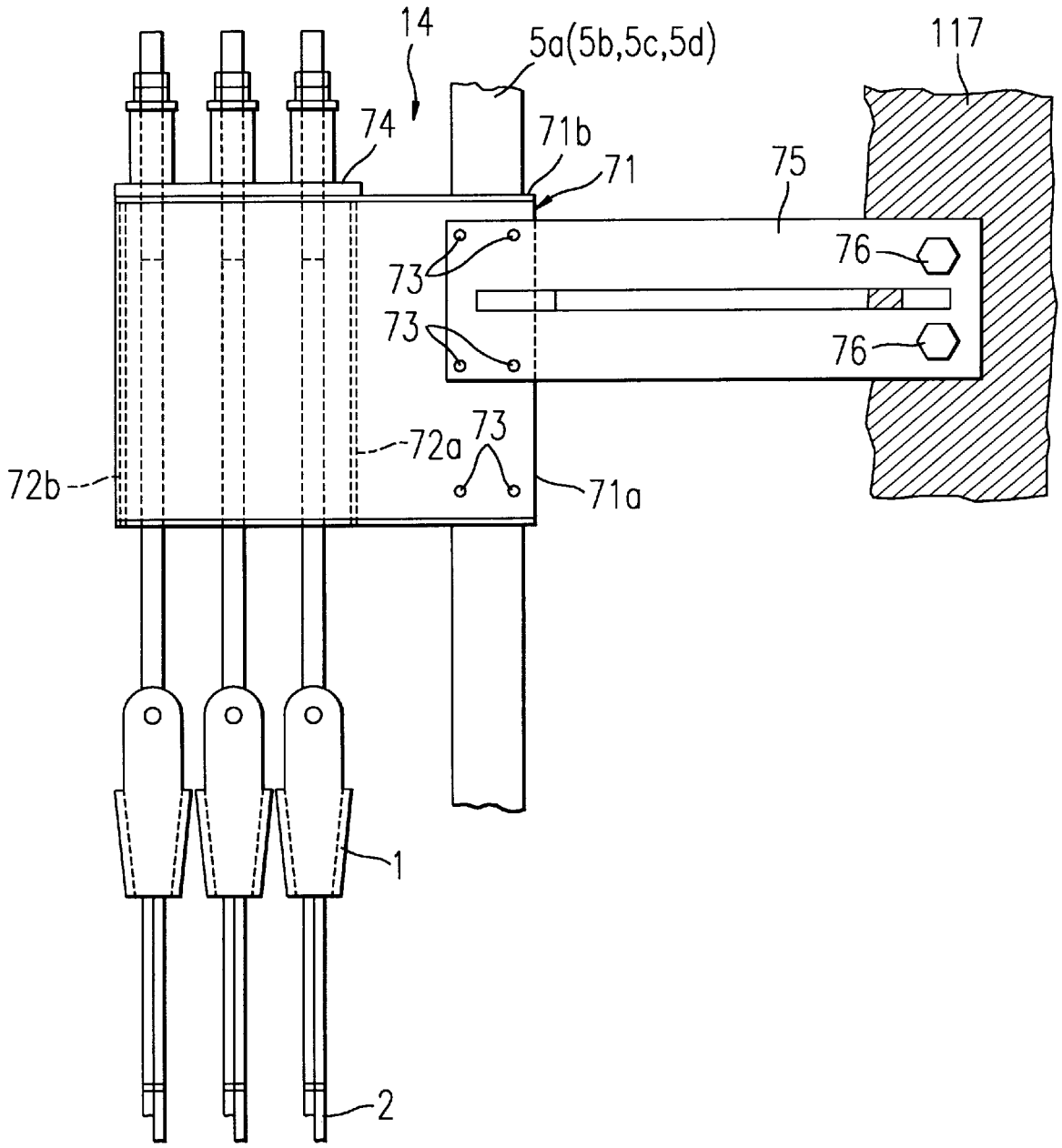
FIG. 15 is a front view of a cable hitch of a seventh embodiment of the present invention.
Figure 16:
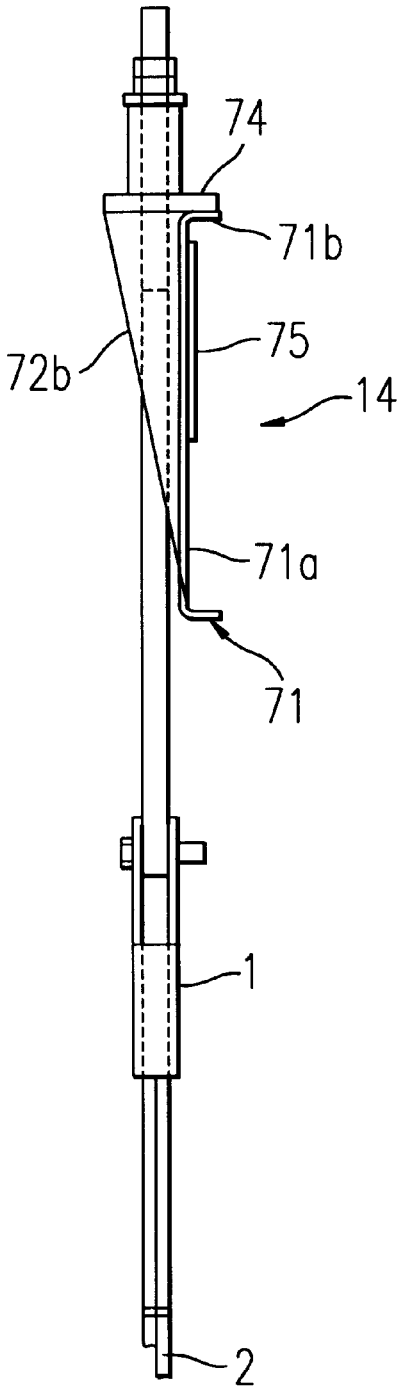
FIG. 16 is a side view of the cable hitch shown in FIG. 15.

FIG. 15 is a front view of a cable hitch 14 of a seventh embodiment of the present invention. FIG. 16 is a side view of the cable hitch 14 shown in FIG. 15. The seventh embodiment modifies a part of the composition of the first embodiment. Hereinafter, only components different from the components explained in the first embodiment shown in FIGS. 2–4 are described.

As shown in FIGS. 15 and 16, a cable hitch 14 is composed of a C-shaped member 71 which is mounted on a back side of the cage guide rail 5*a* such that the longitudinal section has a C-shape. The C-shaped member 71 is composed of a vertically extending portion and a pair of horizontally extending portions.

The vertically extending portion forms a base 71*a* to be secured on the back side of the cage guide rail 5*a*, while an upper side of the horizontally extending portions forms a support 71*b* for supporting the ends of the cables 2.

The base 71*a* of the C-shaped member 71 is extended in the horizontal direction and secured to a back side of the cage guide rail 5*a* by six bolts 73 so as to be wider than the width of the cage guide rails 5*a*. The base 71*a* can be welded to the back side of the cage guide rail 5*a* instead of fastening with the bolts 73.

A support plate 74 is secured on the supports 71*b* of the C-shaped member 71 and supports the shackle rods 1 attached to the ends of the cables 2. The support plate 74 is secured to the supports 71*b* by bolts(not shown). The support plate 74 can otherwise be welded to the supports 71*b*.

A pair of triangular reinforcing plates 72*a* and 72*b* are welded to the C-shaped member 71, thereby strengthening the support plate 74.

Further, an auxiliary plate 75 is secured at one end thereof to a position of the cage guide rail 5*a* where the C-shaped member 71 is attached, and integrally secured to the C-shaped member 71 with the bolts 73. Another end of the auxiliary plate 75 is secured by anchor bolts 76 to a wall 117 of the shaft 110 positioned at the opposite side of the cage guide rail 5*a* as shown in FIG. 15. Alternatively, the other end of the auxiliary plate 75 can be secured to a fixed element of the shaft 110 such as a steel frame of the building, which is positioned at the opposite side of the cage guide rail 5*a*. The auxiliary plate 75 can otherwise be welded to the C-shaped member 71 instead being fastened thereto by the bolts 73.

According to the seventh embodiment, since the cable hitch 14 is mounted on the top or middle of the cage guide rail 5*a* and supports the ends of the cables 2, it is not required that the cable hitch be installed in the machine room as shown in FIG. 1.

Thus, in the case where a two-to-one roping elevator dispenses with a machine room, the size of the shaft can be the same size as the shaft of an elevator with a machine room, it is not necessary to provide a space protruding from the roof of the building for a machine room, and further there is no difficulty to support the ends of the cables 2.

Further, installation of the C-shaped member 71 supported by the auxiliary plate 75 and secured at one end thereof to the wall 117, as shown in FIG. 15, increases safety and strength against a moment applied to the C-shaped member 71.

Figure 18:
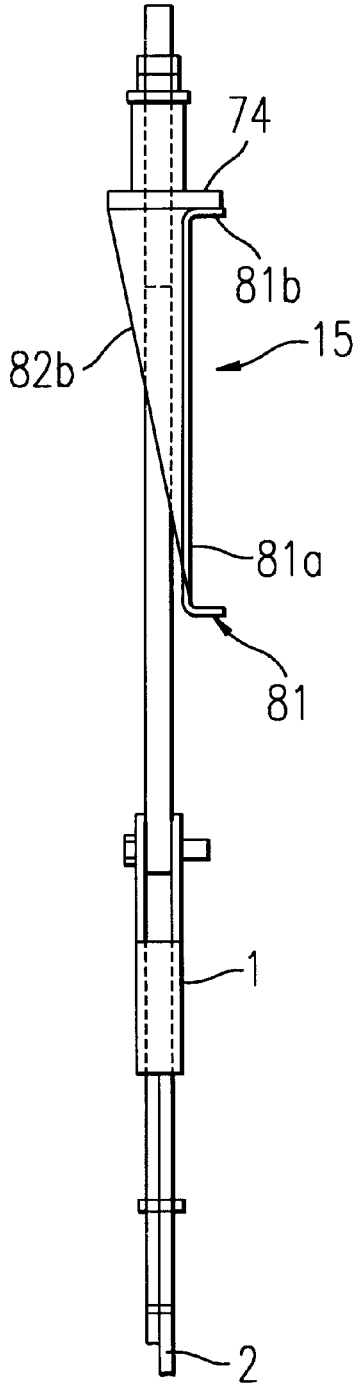
FIG. 18 is a side view of the cable hitch shown in FIG. 17.
Figure 17:
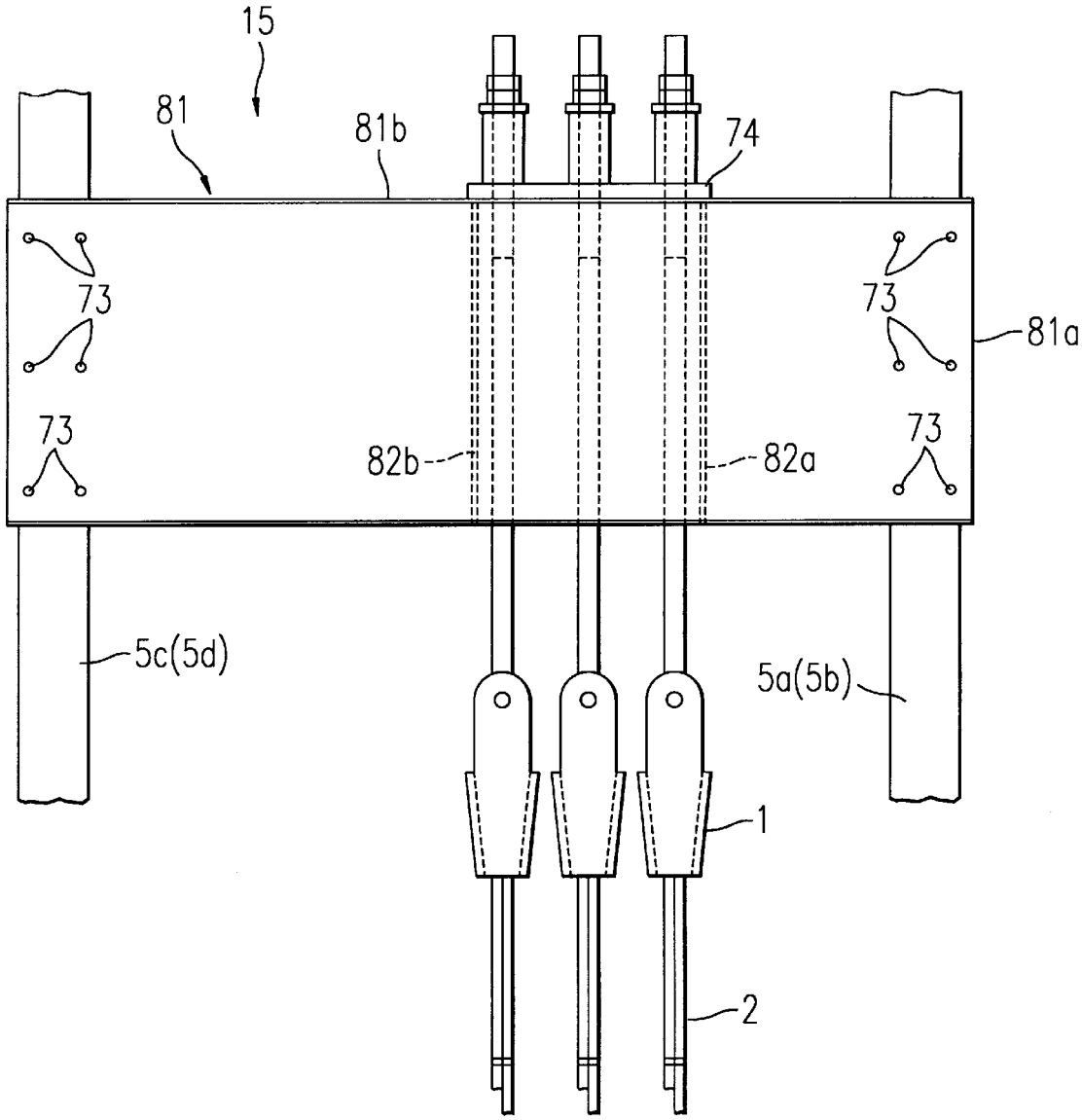
FIG. 17 is a front view of a cable hitch of an eighth embodiment of the present invention.

FIG. 17 is a front view of a cable hitch 15 of an eighth embodiment of the present invention. FIG. 18 is a side view of the cable hitch 15 shown in FIG. 17. The eighth embodiment modifies a part of the seventh embodiment, in which back sides of one of a pair of the cage guide rails 5*a* and 5*b*, and one of a pair of the counterweight guide rails 5*c* and 5*d* flush with each other. Hereinafter, only components different from the components explained in the seventh embodiment shown in FIGS. 15 and 16 are described.

As shown in FIG. 17, the cable hitch 15 is composed of a C-shaped member 81 which is secured at one end thereof to the back side of the cage guide rail 5*a* or 5*b*, and at the opposite end thereof to the back side of the counterweight guide rail 5*c* or 5*d* by bolts 73, and respectively positioned at the same level. Alternatively, the C-shaped member 81 can be welded to the cage guide rail 5*a* and the counterweight guide rail 5*c* instead being fastened thereto by the bolts 73.

The C-shaped member 81 is composed of a vertical extending portion and a pair of horizontally extending portions. The vertically extending portion forms a base 81*a* to be secured on back sides of the cage guide rail 5*a* and the counterweight guide rail 5*c*, while an upper side of the horizontally extending portions forms a support 81*b* for supporting the ends of the cables 2.

A support plate 74 is secured on the support portions 81*b* of the C-shaped member 81 and supports the shackle rods 1 attached to the ends of the cables 2. The support plate 74 is secured to the supports 81*b* by bolts (not shown). The support plate 74 can otherwise be welded to the supports 81*b* instead of the bolts.

A pair of reinforcing plates 82*a* and 82*b* composed of triangular plates are welded to the C-shaped member 81, thereby strengthening the support plate 74.

According to the eighth embodiment, since the C-shaped member 81 is secured at one end thereof to the back side of the cage guide rail 5*a* or 5*b* and the opposite end thereof to the back side of the counterweight guide rail 5*c* or 5*d*, and supports the cables 2, the support plate 74 can efficiently support the bending moment caused by the installation position of the cables 2 being offset from the cage guide rails 5*a* and 5*c*. Thus, the permissible load of the cable hitch 15 is more than a cantilever structure such as the cable hitch 14 shown in FIG. 15, and a distance between the cage guide rail 5*a* or 5*c* and the installation position of the cables 2 can be made longer. As a result, the installation position of the cables 2 can be set more freely.

The cable hitch 15 can be composed of a pair of C-shaped members 71 shown in FIG. 15. In this case, C-shaped members 71 are respectively mounted on the cage guide rail 5*a* and the counterweight guide rail 5*c* at the same level, and the support plate 74 is secured at the opposite ends thereof on respective supports 71*b* of the C-shaped members 71.

FIG. 19 is a front view of a cable hitch of the ninth embodiment of the present invention. The ninth embodiment adds some components to the fourth embodiment shown in FIG. 9 and 10. Hereinafter, only components different from the components explained in the fourth embodiment are described.

As shown in FIG. 19, a plate 95 is supported by hitch springs 92 above the support plate 42 so as to move up and down, and the shackle rods 1 are supported on the plate 95 by hitch springs 91.

A switch 94 is attached at a center of the support plate 42, and a pin 93 is disposed at a position facing the switch 94. The switch 94 and the pin 93 compose a load detector.

If a load of the cage 113 increases, the hitch springs 91 are compressed and the hitch springs 92 are compressed by the reaction force of the hitch springs 91, so that the pin 93 moves downward and activates the switch 94. Thus, the load of the cage 113 can be detected.

The pin 93 is screwed into the plate 95 and a projection length of the pin 93 is adjustable. Thus, the pin 93 can be set such that the switch 94 is activated when the load of the cage 113 exceeds a rated load of the cage 113.

According to the ninth embodiment, a load of the cage 113 can be detected by detecting a deformation of the hitch springs 92. Further, a load to be detected is adjustable by adjusting a distance between the switch 94 and the pin 93.

Various modifications and variations are possible in light of the above teachings. Therefore, it is to be understood that within the scope of the appended claims, the present invention may be practiced otherwise than as specifically described herein.

What is claimed is:

1. An elevator comprising:

a cage configured to ascend and descend in an elevator shaft along a cage guide rail;

a counterweight configured to ascend and descend in said elevator shaft along a counterweight guide rail;

a cable configured to hang and connect said cage and said counterweight;

a drive unit configured to drive said cage and said counterweight by providing motive power for said cable; and at least one cable hitch mounted on one of said cage guide rail and said counterweight guide rail and configured to secure one end of said cable, said cable hitch having a U-shaped horizontal section and comprising a base secured to a back side of said one of said cage guide rail and said counterweight guide rail, a plurality of support arms configured to support said end of said cable and to be extended in the horizontal direction from both side edges of said base such that said one of said cage guide rail and said counterweight guide rail is disposed between said support arms, and a support plate mounted on said support arms configured to support said end of said cable, said support plate and said base defining an opening by which said one of said cage guide rail and said counterweight guide rail can pass between said base and said support plate.

* * * * *